US008952146B2

(12) United States Patent
Kapoor et al.

(10) Patent No.: US 8,952,146 B2
(45) Date of Patent: Feb. 10, 2015

(54) PROCESS FOR MANUFACTURING LOW-FIBRILLATING CELLULOSIC FIBER

(75) Inventors: Bir Kapoor, Mumbai (IN); Preeti Lodha, Mumbai (IN); Parag Patil, Mumbai (IN); Aditya Shrivastava, Nagda (IN); Kishore Shouche, Nagda (IN); Eric Uerdingen, Speyer (DE); Michael Siemer, Mannheim (DE); Thomas Wisniewski, Bensheim (DE); Uwe Vagt, Mannheim (DE); Massonne Klemens, Bad Durkheim (DE)

(73) Assignee: Grasim Industries Limited, Nagda (IN)

( * ) Notice: Subject to any disclaimer, the term of this patent is extended or adjusted under 35 U.S.C. 154(b) by 59 days.

(21) Appl. No.: 13/440,077

(22) Filed: Apr. 5, 2012

(65) Prior Publication Data

US 2012/0253031 A1 Oct. 4, 2012

Related U.S. Application Data

(63) Continuation of application No. PCT/IN2010/000660, filed on Oct. 5, 2010.

(30) Foreign Application Priority Data

Oct. 7, 2009 (IN) ..... 2334/MUM/2009

(51) Int. Cl.

| | |
|---|---|
| ***D01F 2/08*** | (2006.01) |
| ***D01F 2/02*** | (2006.01) |
| ***D01D 5/06*** | (2006.01) |
| ***C08B 16/00*** | (2006.01) |

(52) U.S. Cl.
CPC ... *D01F 2/02* (2013.01); *D01D 5/06* (2013.01)
USPC ..... 536/124; 536/57; 536/128

(58) Field of Classification Search
CPC ..... C08B 16/00; D01F 2/08
USPC ..... 536/57, 124, 128
See application file for complete search history.

(56) References Cited

U.S. PATENT DOCUMENTS

| | | | | |
|---|---|---|---|---|
| 5,417,909 | A * | 5/1995 | Michels et al. | 264/177.13 |
| 6,130,327 | A | 10/2000 | Wolf et al. | |
| 6,756,001 | B2 * | 6/2004 | Meraldi et al. | 264/187 |
| 7,749,318 | B2 | 7/2010 | Maase et al. | |
| 2008/0190321 | A1 | 8/2008 | Maase et al. | |
| 2008/0269477 | A1 | 10/2008 | Stegmann et al. | |

FOREIGN PATENT DOCUMENTS

| | | | |
|---|---|---|---|
| CN | 1851063 | A | 10/2006 |
| CN | 101160325 | A | 4/2008 |
| CN | 101215725 | A | 7/2008 |
| CN | 101328626 | A | 12/2008 |
| EP | 574870 | A1 * | 12/1993 |
| EP | 1008678 | A2 * | 6/2000 |
| WO | WO-2006/000197 | A1 | 1/2006 |
| WO | WO-2007/076979 | A1 | 7/2007 |
| WO | WO-2007/128268 | A2 | 11/2007 |
| WO | WO-2008/133269 | A1 | 11/2008 |
| WO | WO-2009/062723 | A1 | 5/2009 |

OTHER PUBLICATIONS

Hui-hui Zhang et al. "Structure and Properties of Cellulose Fiber from Ionic Liquid." State Key Laboratory for Modification of Chemical Fibers and Polymer Materials, College of Material Science and Engineering, Donghua University, Shanghai. Nov. 2007.
International Search Report regarding Application No. PCT/IN2010/000660, mailed May 19, 2011.
International Search Report regarding Application No. PCT/IN2010/000659, mailed May 19, 2011.

* cited by examiner

*Primary Examiner* — Patrick Lewis
*Assistant Examiner* — Everett White
(74) *Attorney, Agent, or Firm* — Harness, Dickey & Pierce, P.L.C.

(57) ABSTRACT

The present invention provides a process for producing low fibrillating cellulose fibers by a dry-jet-wet spinning process wherein cellulose is treated with a solvent containing imidazolium ionic salt in a spinneret maintained at a temperature of 100-120° C. and the spun fibers drawn to the coagulation bath containing ionic salt with the draw ratio less than 5, to produce fibers with fibrillating index less than or equal to 3.

22 Claims, No Drawings

PROCESS FOR MANUFACTURING LOW-FIBRILLATING CELLULOSIC FIBER

CROSS-REFERENCE TO RELATED APPLICATIONS

This application is a continuation of International Application No. PCT/IN2010/000660, filed Oct. 5, 2010. This application claims priority to Indian Application No. 2334/MUM/2009, filed Oct. 7, 2009. The disclosure(s) of the above applications are incorporated herein by reference.

FIELD

The disclosure relates to a process for preparing non-fibrillating cellulosic fibers and cellulosic fibers prepared by the process.

DEFINITIONS

The term "Viscose Process" is a process used for the preparation of man-made cellulose fibers made from cellulose which involves the use of solvents such as sodium hydroxide (an alkali), carbon disulfide and acid solution, and wet spinning of the fibers.

The term Lyocell Process is the process for manufacturing of cellulose fibers which involve the use of direct solvents such as N-methyl Morpholine oxide (NMMO) to dissolve the cellulose and dry-jet-wet spinning of the fibers.

The term "Wet Spinning Process" in the context of the present disclosure is a process which involves spinning of the polymer dope directly into a liquid bath.

The term "Dry-Jet-Wet Spinning" in the context of the present disclosure is a spinning process which involves spinning of the polymer dope through an air gap into a coagulation bath.

The term "Ionic Liquids" refer to salts that are stable liquids having extremely low-saturated vapor pressures and good thermal stability.

BACKGROUND

Cellulosic fibers such as cotton, rayon and lyocell are used in the manufacture of textiles and non-wovens.

The conventional method for the commercial preparation of cellulosic fibers is the viscose process. In one of the conventional processes for the manufacture of cellulosic fibers, cellulose prepared from either wood pulp, is treated with sodium hydroxide and then with carbon disulfide to form cellulose xanthate. The cellulose xanthate thus formed is dissolved in dilute solution of sodium hydroxide to obtain a thick solution called viscose. The viscose is then forced through tiny openings in a spinneret into an acid solution, which coagulates it in the form of fine strands of fibers. In the wet spinning method, the process involves spinning of polymer dope directly into a liquid bath. The cellulosic fibers obtained from the viscose process are non-fibrillating, but possess low strength. Further, the viscose process involves the use of hazardous liquids such as carbon disulfide and sulphuric acid thus making entire process not environment friendly.

In another conventional process for manufacturing cellulosic fibers, cellulose is dissolved in a cupramonium solution to form a solution which is forced through submerged spinnerets into a dilute sulphuric acid, which acts as coagulating agent, to form fibers. The main drawback of the process is that efficient ammonia recovery is difficult to achieve and the process is more expensive than the viscose rayon process.

The cellulose/lyocell fibers are also known to be obtained using a dry jet wet spinning technique using N-methylmorpholine N-oxide hydrate. Although, the dry jet wet spinning process gives significantly higher fiber tenacity and modulus than the conventional wet jet spinning process, the use of NMMO is not desirable due to the fact that NMMO is thermally unstable and is explosive at higher temperature leading to its degradation and generation of coloured compounds that affects the whiteness of the fibers and increasing the cost of the fiber and the fiber prepared from the above process show high fibrillation tendency, which affects the appearance of the product made from such fibers. Further, to reduce the fibrillation tendency, the conventional fibers are required to be further processed by cross-linking agents or by mechanical, chemical or enzymatic means which further add to the cost of the overall process.

WO 2009/062723 of BASF published on May 22, 2009, relates to a spinning process and discloses use of EMIM octanoate and imidazolium-dialkylphosphates.

WO 2006/000197 and WO 2007/128268 of TITK disclose a spinning process of cellulose in ionic liquid.

WO 2008/133269 of Nisshinbo Industries discloses ionic liquids, wherein the cation (including imidazolium) has at least one alkoxyalkyl group and the anion is dimethyl phosphate and has good solubility of cellulose and fibers are mentioned without any details or examples.

WO2007076979 of BASF discloses a solution system for biopolymers in the form of carbohydrates, solution system containing molten ionic liquid, also additives optionally being contained in the solution system, is described. This solution system contains a protic solvent or a mixture of several protic solvents, and in the case where the protic solvent is solely water, it is present in the solution system in an amount of more than about 5 wt. %. The patent provides a process for regenerated cellulose non-fibrillating spun fibers.

There is, therefore, a need to develop a process, for preparing non-fibrillating cellulosic fibers, which is simple, cost effective, environment friendly and which can overcome the shortcomings of the conventional processes without requiring the use of harmful solvents. The current disclosure describes a process of manufacturing low fibrillating cellulosic fibers using dry-jet-wet spinning under specific spinning conditions using ionic liquids as solvents for cellulose.

OBJECTS

Some of the non-limiting objects of the present disclosure, which at least one embodiment herein satisfy, are as follows:

It is an object of the disclosure to provide a process for preparing non-fibrillating cellulosic fibers which is simple, efficient and cost effective.

It is another object of the disclosure to provide a process for preparing non-fibrillating cellulosic fibers which is environment friendly.

It is another object of the disclosure to provide a process for preparing non-fibrillating fibers which provides cellulosic fibers with high strength and elongation properties.

It is further object of the invention to provide a process for preparing non-fibrillating cellulosic fibers which employ the solvents which are able to withstand high temperatures and which do not result in the formation of degraded products at higher temperatures.

It is a further object of the invention to provide a process for preparing non-fibrillating cellulosic fibers which employ solvents that can be recycled and reused.

It is still further object of the invention to provide a process for preparing non-fibrillating cellulosic fibers by dry-jet-wet spinning technique.

SUMMARY

Accordingly, the invention provides a process for producing low fibrillating cellulose fibers by a dry-jet-wet spinning process comprising following steps:

a. dissolving cellulose in a solvent system containing at least one ionic liquid to form a polymer solution wherein the ionic liquid has cations with heterocyclic ring system containing either one or two nitrogen atoms, with each such nitrogen atom substituted by an alkyl group having 1 to 20 carbon atoms, and anions being at least one selected from the group consisting of carboxylate anion of formula Ra—$COO^-$ and Ra is alkyl group having 1 to 20 carbon atoms, preferably Ra is an alkyl group having 5 to 9 carbon atom, and phosphate anion of formula Rb-Rc-$P0_4^{''}$, Rb and Rc are alkyl groups having 1 to 20 carbon atoms, preferably having 1 to 5 carbon atoms, and the total number of carbon atoms in the alkyl groups of the anion and cation being at least 5, preferably at least 7, more preferably at least 9;

b. spinning fibres from said polymer solution in a spinneret at a temperature in the range of 80° C. to 140° C., 90° C. to 130° C. preferably in the range of 100° C. to 120° C.

c. drawing the spun fibres from the spinneret through an air gap of 2 mm to 150 mm, preferably 5 mm to 50 mm, more preferably 5 mm to 30 mm, wherein the draw ratio is between 0.5 and 5.0, preferably between 0.5 and 4.0 and most preferably between 1 and 3.5, into a coagulation bath comprising up to 70%, preferably 10% to 40% by weight of said ionic liquid; and d. washing and drying the drawn fibers.

Typically, the concentration of cellulose in the polymer solution is from 6% to 20%, preferably 8% to 16%, more preferably 10% to 14%.

The weight average degree of polymerisation of cellulose is 100 to 4000, preferably 200 to 1200.

The fiber is contacted with air or an inert gas such as Nitrogen gas, helium gas and argon gas in the air gap, the temperature in the air gap is maintained from −5° C. to 50° C., preferably 5° C. to 30° C., the absolute humidity in the air gap is maintained at less than 75 gram per cubic meter.

Typically, the coagulation bath contains at least 30% protic solvent such as water, methanol, ethanol, glycerol, n-propanol, iso-propanol and mixtures thereof.

The temperature of the coagulation bath is from −5° C. to 60° C., preferably 5° C. to 40° C., more preferably 20° C. to 40° C.

The solvent system contains at least 70% ionic liquids by weight of solvent. The solvent system further comprises at least one solvent selected from the group consisting of water, dimethyl sulfoxide, dimethyl acetamide, dimethylformamide N-methyl pyrrolidone and mixtures thereof.

Typically, the ionic liquid is a 1,3-disubstituted imidazolium salt of the formula I

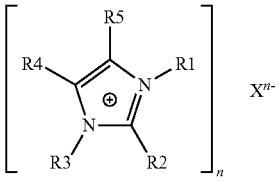

where

R1 and R3 are each, independently of one another, an organic group having 1 to 20 carbon atoms, R2, R4 and R5 are each, independently of one another, an H atom or an organic group having from 1 to 20 carbon atoms, X is a carboxylate anion of formula Ra—$COO^-$ where in Ra is alkyl group having 1 to 20 carbon atoms, preferably Ra is an alkyl group having 6 to 9 carbon atom, or phosphate anion of formula Rb-Rc-$P0_4^-$, where in Rb and Rc are alkyl groups having 1 to 20 carbon atoms, preferably having 1 to 5 carbon atoms, and n is 1, 2 or 3.

In one embodiment of the present invention, R1 and R3 are same.

Typically, the total number of carbon atoms in the alkyl groups in the anion and cation is at the most 30, preferably at the most 26, most preferably at the most 22.

Typically, X is Octanoate.

Typically, the ionic liquid is at least one selected from the group consisting of Dibutyl imidazolium acetate, Dipentylimidazolium acetate, Dihexyl imidazolium acetate, Dipropylimidazolium octanoate, Dibutyl imidazolium octanoate, 1-Ethyl-3-methyl imidazolium heptanoate, 1-Ethyl-3-methylimidazolium octanoate, 1-Ethyl-3-methyl imidazolium nonanoate, 1-Ethyl-3-methyl imidazolium decanoate, 1-Ethyl-3-methyl imidazolium undecanoate, 1-Ethyl-3-methyl imidazolium dodecanoate, 1-Ethyl-3-methyl immidazolium diethyl phosphate, Diethyl imidazolium octanoate, and 1-Decyl-3-methyl imidazolium acetate.

Typically, the fibres produced in accordance with the present disclosure have fibrillation index less than or equal to 3.

DETAILED DESCRIPTION

The process for preparing a low-fibrillating cellulosic fiber involves following steps;

dissolving cellulose in a solvent containing at least 50% of at least one ionic liquid to form a polymer solution, spinning the fibres from said solution in a spinneret at a temperature in the range of 80° C. to H0° C., drawing the spun fibres at a draw ratio of less than 5 from the spinneret through an air gap of 2 mm to 150 mm into a coagulation bath; and washing and drying the drawn fibers.

The spinning temperature is in the range of 80° C. to 140° C., preferably 90° C. to 130° C., more preferably the spinning temperature is 100-120° C.

The ionic liquid comprises a cation with a heterocyclic ring system containing at least one nitrogen atom, such as but not limited to imidazolium, pyridinium, pyrazolium, wherein each nitrogen atom is substituted by an alkyl group having 1-20 carbon atoms and the total number of carbon atoms in the alkyl groups in the cation and the anion being at least 6.

The ionic liquid has a general formula I

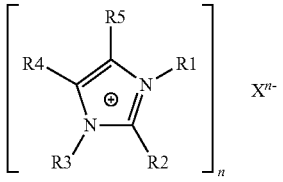

R1 and R3 are each, independently of one another, an organic group having 1 to 20 carbon atoms, R2, R4 and R5 are each, independently of one another, an H atom or an organic group having from 1 to 20 carbon atoms, X is an anion, wherein anion in the ionic liquid is a carboxylate anion of formula Ra—$COO^-$ wherein $R_a$ is an alkyl group having 1-20 carbon atoms or is a dialkyl phosphate anion of formula Rb-Rc-$P0_4$- wherein Rb and Rc are alkyl group having 1-20 carbon atoms, preferably Rb and Rc are alkyl groups having independently 1-5 carbon atoms and n is 1, 2 or 3.

The total number of carbon atoms in the alkyl groups of the anion and cation being at least 5, preferably at least 7, more preferably at least 9. The total number of carbon atoms in the alkyl groups in the anion and cation is at the most 30, preferably at the most 26, more preferably at the most 22.

In preferred embodiment of the present invention, the ionic liquid is selected from a group consisting of Dibutyl imidazolium acetate, Dipentylimidazolium acetate, Dihexyl imidazolium acetate, Dipropylimidazolium octanoate, Dibutyl imidazolium octanoate, 1-Ethyl-3-methyl imidazolium heptanoate, 1-Ethy 1-3-methyl imidazolium octanoate, 1-Ethyl-3-methyl imidazolium nonanoate, 1-Ethyl-3-methyl imidazolium decanoate, 1-Ethyl-3-methyl imidazolium-undecanoate, 1-Ethyl-3-methyl imidazolium dodecanoate, 1-Ethyl-3-methyl immidazolium diethyl phosphate, Diethyl imidazolium octanoate, and 1-Decyl-3-methyl imidazolium acetate.

The concentration of cellulose in the formulation is in the range of 6% to 20%, preferably in the range of 8% to 14%, degree of polymerization of cellulose material is in the range of 100 to 4000, preferably in the range of 200 to 1200.

The solvent system further comprises a solvent selected from the group consisting of water, dimethyl sulfoxide, dimethyl acetamide, dimethylformamide N-methyl pyrrolidone and mixtures thereof.

The fibers are drawn at a draw ratio of less than 5, preferably in the range of 2 to 3, distance of air gap between the spinneret and coagulation bath is in the range of 2 mm to 150 mm, preferably in the range of 5 mm to 50 mm, more preferably 5 mm to 30 mm. The fibers emerging from the spinneret are contacted with air or an inert gas. The temperature of the air gap is maintained in the range of −5° C. to 50° C., preferably in the range of 5° G to 30° C. and absolute humidity in the air is <75 g/cubic meter. The fibres are drawn in to a coagulating bath containing ionic liquid up to 70% by weight.

The coagulation bath further contains at least 30% protic solvent such as water, methanol, ethanol, glycerol, n-propanol and iso-propanol and mixtures thereof. The temperature of the coagulation bath is in the range of −5° C. to 60° C., preferably in the range of 5° C. to 40° C.

EXAMPLES

Cellulose of 700 degree of polymerisation was dissolved in an ionic liquid (as given in Table 1) to form a 12% solution and spun from a 60 micron hole spinneret through an air gap of 10 mm into a coagulation bath containing 20% specific ionic liquid maintained at 30 degrees Celsius to form a fiber. Draw ratio presented in the table below is calculated as the ratio of winding speed and linear speed of the filament at the spinneret. TC in Table 1 is the total number of carbon atoms in the alkyl groups of the anion and cation of the ionic liquid in the solvent system. The spinning temperature, draw ratio and fibrillation property of the spun fibers are presented in Table 1.

TABLE 1

Spinning Experiments Details including Solvent, Spinning Parameters and Fibrillation Property

| SN | Solvent | TC | Spinning temp Celsius | Draw ratio | Fibrillation index |
|---|---|---|---|---|---|
| 1 | 1-Decyl-3-Methyl Imidazolium acetate | 12 | 90 | 3.0 | Low |
| 2 | 1-Decyl-3-Methyl Imidazolium acetate | 12 | 90 | 5.5 | High |
| 3 | 1-Decyl-3-Methyl Imidazolium acetate | 12 | 70 | 3.5 | High |
| 4 | 1-Decyl-3-Methyl Imidazolium acetate | 12 | 120 | 3.5 | Low |
| 5 | 1-ethyl-3-methyl imidazolium octanoate | 10 | 90 | 3.0 | Low |
| 6 | 1-ethyl-3-methyl imidazolium octanoate | 10 | 90 | 5.5 | High |
| 7 | 1-ethyl-3-methyl imidazolium octanoate | 10 | 70 | 4.0 | High |
| 8 | 1-ethyl-3-methyl imidazolium octanoate | 10 | 130 | 4.0 | Low |
| 9 | 1-ethyl-3-ethyl imidazolium octanoate | 11 | 90 | 3.0 | Low |
| 10 | 1-ethyl-3-ethyl imidazolium octanoate | 11 | 90 | 5.5 | High |
| 11 | 1-ethyl-3-ethyl imidazolium octanoate | 11 | 70 | 4.5 | High |
| 12 | 1-ethyl-3-ethyl imidazolium octanoate | 11 | 130 | 4.5 | Low |
| 13 | 1-Ethyl-3-methyl immidazolium diethyl phosphate | 7 | 90 | 3.0 | Low |
| 14 | Dibutyl imidazolium acetate | 9 | 120 | 3.5 | Low |
| 15 | Dibutyl imidazolium octanoate | 15 | 120 | 3.5 | Low |

Fibrillation:

Take about 0.003 g of 20 mm long cut fibers with 5 ml distilled water in a polypropylene test tube of 1.5 cm inner diameter and 10 cm tube height. Install the tube on a shaker and subject the fiber to 80 Hz and 12 cm amplitude for 90 minutes. Place the treated fiber on a glass slide and observe under the microscope.

Fibrillation index is the number of fibrils observed on a 100 micron fiber length using an optical microscope. Fibrillation index of greater than 3 is high fibrillating and equal to or less than 3 is low fibrillating.

TECHNICAL ADVANCEMENT

The process in accordance with the present invention results in the formation of cellulosic spun fibers which are non-fibrillating and are used in various applications such as textiles and non-wovens. The ionic liquids used in the process of the invention can be recovered and reused, thus making overall process efficient and economical. The process of present invention does not generate harmful waste products and is, therefore, environment friendly.

While considerable emphasis has been placed herein on the particular features of the preferred embodiment and the improvisation with regards to it, it will be appreciated that various modifications can be made in the preferred embodiments without departing from the principles of the invention. These and the other modifications in the nature of the invention will be apparent to those skilled in the art from disclosure herein, whereby it is to be distinctly understood that the foregoing descriptive matter is to interpreted merely as illustrative of the invention and not as a limitation.

What is claimed is:

1. A process for producing low fibrillating cellulose fibers by a dry-jet-wet spinning process comprising the following steps:

a. dissolving cellulose in a solvent system containing at least one ionic liquid to form a polymer solution wherein the ionic liquid has cations with heterocyclic ring system containing either one or two nitrogen atoms, with each such nitrogen atom substituted by an alkyl group having 1 to 20 carbon atoms, and anions being at least one selected from the group consisting of carboxylate anion of formula Ra—$COO^-$ and Ra is alkyl group having 7 to 20 carbon atoms, and phosphate anion of formula Rb-Rc-$PO_4^-$, Rb and Rc are alkyl groups having 1 to 20 carbon atoms, and the total number of carbon atoms in the alkyl groups of the anion and cation being at least 9;

b. spinning fibers from said polymer solution in a spinneret at a temperature in the range of 80° C. to 140° C.;

c. drawing the spun fibers from the spinneret through an air gap of 2 mm to 50 mm, wherein the draw ratio is between 0.5 and 5.0, into a coagulation bath consisting essentially of 20 to 70% by weight of said ionic liquid and at least 30% by weight of a protic solvent selected from water, methanol, ethanol, glycerol, n-propanol, iso-propanol and mixtures thereof; and d. washing and drying the drawn fibers.

2. The process as claimed in claim 1, wherein the ionic liquid is at least one selected from the group consisting of Dipropyl imidazolium octanoate, Dibutyl imidazolium octanoate, 1-Ethyl-3-methyl imidazolium heptanoate, 1-Ethyl-3-methyl imidazolium octanoate, 1-Ethyl-3-methyl imidazolium nonanoate, 1-Ethyl-3-methyl imidazolium decanoate, 1-Ethyl-3-methyl imidazolium undecanoate, 1-Ethyl-3-methyl imidazolium dodecanoate, 1-Ethyl-3-methyl imidazolium diethyl phosphate, and Diethyl imidazolium octanoate.

3. The process as claimed in claim 1, wherein the concentration of cellulose in the polymer solution is from 6% to 20%.

4. The process as claimed in claim 1, wherein the weight average degree of polymerisation of cellulose is between 100 and 4000.

5. The process as claimed in claim 1, wherein the solvent system contains at least 50% ionic liquids by weight of the solvent system.

6. The process as claimed in claim 1, wherein the solvent system further comprises at least one solvent selected from the group consisting of water, dimethyl sulfoxide, dimethyl acetamide, dimethylformamide N-methylpyrrolidone and mixtures thereof.

7. The process as claimed in claim 1, wherein fiber is contacted with air or an inert gas, inert gas is selected from the group consisting of Nitrogen gas, Helium gas and Argon gas, in the air gap.

8. The process as claimed in claim 1, wherein the temperature in the air gap is maintained from −5° C. to 50° C.

9. The process as claimed in claim 1, wherein the absolute humidity in the air gap is maintained at less than 75 grams per cubic meter.

10. The process as claimed in claim 1, wherein the temperature of the coagulation bath is in the range of −5° C. to 60° C.

11. The fibers produced in accordance with claim 1 having a fibrillation index less than or equal to 3.

12. The process as claimed in claim 1, wherein the method step of spinning fibers from said polymer solution in the spinneret is carried out at a temperature in the range of 100° C. to 120° C.

13. The process as claimed in claim 1, wherein the draw ratio ranges between 1.0 and 3.5.

14. A process for producing low fibrillating cellulose fibers by a dry-jet-wet spinning process comprising the following steps:

a. dissolving cellulose in a solvent system containing at least one 1,3-disubstituted imidazolium salt of the formula I

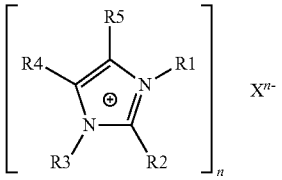

where

R1 and R3 are each, independently of one another, an organic group having 1 to 20 carbon atoms;

R2, R4 and R5 are each, independently of one another, an H atom or an organic group having from 1 to 20 carbon atoms;

b. X is an anion, anion being at least one selected from the group consisting of carboxylate anion of formula Ra—$COO^-$ wherein Ra is an alkyl group having 7 to 20 carbon atoms, and phosphate anion of formula Rb-Rc-$PO_4^-$ wherein Rb and Rc are alkyl groups having 1 to 20 carbon atoms; and n is 1, 2 or 3 to form a polymer solution, and the total number of carbon atoms in the alkyl groups of the anion and cation in formula I being at least 9;

c. spinning fibers from said polymer solution in a spinneret at a temperature in the range of 80° C. to 140° C.;

d. drawing the spun fibers from the spinneret through an air gap of 2 mm to 50 mm, wherein the draw ratio is between 0.5 and 5.0, into a coagulation bath consisting essentially of 20 to 70% by weight of said ionic liquid and at least 30% by weight of a protic solvent selected from water, methanol, ethanol, glycerol, n-propanol, iso-propanol and mixtures thereof; and e. washing and drying the drawn fibers.

15. The process as claimed in claim 14, wherein the total number of carbon atoms in the alkyl groups in the anion and cation in formula I is at the most 30.

16. The process as claimed in claim 14, wherein R1 and R3 are same.

17. The process as claimed in claim 14, wherein X is Octanoate.

18. The process as claimed in claim 14, wherein X is diethyl phosphate.

19. The fibers produced in accordance with claim 14 having a fibrillation index less than or equal to 3.

20. The process as claimed in claim 14, wherein the total number of carbon atoms in the alkyl groups of the anion and cation in formula I is at least 9.

21. The process as claimed in claim 14, wherein the method step of spinning fibers from said polymer solution in the spinneret is carried out at a temperature in the range of 100° C. to 120° C.

22. The process as claimed in claim 14, wherein the draw ratio ranges between 1.0 and 3.5.

* * * * *